US007841708B2

(12) United States Patent
Morgan et al.

(10) Patent No.: US 7,841,708 B2
(45) Date of Patent: Nov. 30, 2010

(54) FLUDICALLY CONTROLLED INKJET PRINTHEAD

(75) Inventors: John Douglas Peter Morgan, Balmain (AU); Kia Silverbrook, Balmain (AU); Vesa Karppinen, Balmain (AU); David John Worboys, Balmain (AU); Patrick John McAuliffe, Balmain (AU); Norman Micheal Berry, Balmain (AU); David William Jensen, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 581 days.

(21) Appl. No.: 11/495,819

(22) Filed: Jul. 31, 2006

(65) Prior Publication Data

US 2007/0206070 A1 Sep. 6, 2007

Related U.S. Application Data

(63) Continuation-in-part of application No. 11/482,982, filed on Jul. 10, 2006, now Pat. No. 7,645,034.

(30) Foreign Application Priority Data

| | | |
|---|---|---|
| Mar. 3, 2006 | (AU) | 2006901084 |
| Mar. 7, 2006 | (AU) | 2006901287 |
| Mar. 15, 2006 | (AU) | 2006201083 |
| Mar. 15, 2006 | (AU) | 2006201084 |
| Mar. 15, 2006 | (AU) | 2006201204 |

(51) Int. Cl.
*B41J 2/175* (2006.01)

(52) U.S. Cl. ..... 347/85

(58) Field of Classification Search ..... 347/85, 347/74, 89, 30, 40, 93, 86; 222/394; 439/212
See application file for complete search history.

(56) References Cited

U.S. PATENT DOCUMENTS

| | | | | |
|---|---|---|---|---|
| 3,661,304 | A * | 5/1972 | Martinez et al. | 222/394 |
| 4,038,667 | A | 7/1977 | Hou et al. | |
| 4,494,124 | A | 1/1985 | Piatt et al. | |
| 4,577,203 | A | 3/1986 | Kawamura | |
| 4,959,662 | A | 9/1990 | Kobayashi | |
| 5,592,201 | A | 1/1997 | Lim | |
| 5,956,062 | A * | 9/1999 | Omata et al. | 347/89 |
| 6,174,052 | B1 * | 1/2001 | Eremity et al. | 347/74 |
| 6,213,601 | B1 * | 4/2001 | Akuzawa et al. | 347/89 |
| 6,439,908 | B1 * | 8/2002 | Silverbrook et al. | 439/212 |
| 2002/0041299 | A1 | 4/2002 | Lee et al. | |
| 2002/0047882 | A1 * | 4/2002 | Karlinski et al. | 347/85 |
| 2002/0126169 | A1 | 9/2002 | Wyngaert et al. | |

(Continued)

FOREIGN PATENT DOCUMENTS

| | | |
|---|---|---|
| EP | 0178884 A2 | 4/1986 |

(Continued)

*Primary Examiner*—Stephen D Meier
*Assistant Examiner*—Carlos A Martinez, Jr.

(57) ABSTRACT

An inkjet printer that has a printhead IC with and array of ink ejection nozzles, an ink manifold for distributing ink to the printhead IC, the ink manifold having an ink inlet and an ink outlet, an accumulator, and a downstream pump in fluid communication with the ink outlet. The downstream pump is independently operable. This allows the printhead to be primed or deprimed for storage and transport and it allows the printhead IC to be cleaned by a foam formed by air forced through the ink election nozzles.

16 Claims, 12 Drawing Sheets

U.S. PATENT DOCUMENTS

| | | | | |
|---|---|---|---|---|
| 2004/0022570 | A1 | 2/2004 | Ioka et al. | |
| 2005/0041060 | A1* | 2/2005 | Taniguchi | 347/30 |
| 2005/0151802 | A1 | 7/2005 | Neese et al. | |
| 2005/0157009 | A1* | 7/2005 | Silverbrook et al. | 347/40 |
| 2005/0248642 | A1* | 11/2005 | Huliba | 347/93 |
| 2006/0007254 | A1 | 1/2006 | Tanno et al. | |
| 2006/0066697 | A1* | 3/2006 | Inoue | 347/89 |
| 2006/0139419 | A1* | 6/2006 | Shigemura | 347/85 |
| 2006/0227190 | A1* | 10/2006 | Ishizawa et al. | 347/86 |

FOREIGN PATENT DOCUMENTS

| | | | |
|---|---|---|---|
| EP | 0931662 | | 7/1999 |
| EP | 1375146 | A | 1/2004 |
| EP | 1405728 | | 4/2004 |
| GB | 2112715 | | 7/1983 |
| JP | 56-146761 | A | 11/1981 |
| JP | 58-39465 | A | 3/1983 |
| JP | 63-87241 | A | 4/1988 |
| JP | 2000-203050 | A | 7/2000 |
| WO | WO 2005/108096 | A | 11/2008 |

* cited by examiner

FLUDICALLY CONTROLLED INKJET PRINTHEAD

CROSS REFERENCE TO RELATED APPLICATIONS

The present application is a Continuation-In-Part of U.S application Ser. No. 11/482,982 filed Jul. 10, 2006, now issued U.S. Pat. No. 7,645,034, all of which are herein incorporated by reference.

FIELD OF THE INVENTION

The present invention relates to the field of printing and in particular inkjet printing.

CO-PENDING APPLICATIONS

The following applications have been filed by the Applicant simultaneously with the present application:

| | | | | |
|---|---|---|---|---|
| 11/495,815 | 11/495,816 | 11/495,817 | 11/495,814 | 11/495,823 |
| 11/495,822 | 7,523,672 | 11/495,820 | 11/495,818 | |

The disclosures of these co-pending applications are incorporated herein by reference.

CROSS REFERENCES TO RELATED APPLICATIONS

Various methods, systems and apparatus relating to the present invention are disclosed in the following US Patents/Patent Applications filed by the applicant or assignee of the present invention:

| | | | | |
|---|---|---|---|---|
| 6,750,901 | 6,476,863 | 6,788,336 | 7,249,108 | 6,566,858 |
| 6,331,946 | 6,246,970 | 6,442,525 | 7,346,586 | 09/505,951 |
| 6,374,354 | 7,246,098 | 6,816,968 | 6,757,832 | 6,334,190 |
| 6,745,331 | 7,249,109 | 7,197,642 | 7,093,139 | 7,509,292 |
| 10/636,283 | 10/866,608 | 7,210,038 | 7,401,223 | 10/940,653 |
| 10/942,858 | 7,364,256 | 7,258,417 | 7,293,853 | 7,328,968 |
| 7,270,395 | 7,461,916 | 7,510,264 | 7,334,864 | 7,255,419 |
| 7,284,819 | 7,229,148 | 7,258,416 | 7,273,263 | 7,270,393 |
| 6,984,017 | 7,347,526 | 7,357,477 | 7,465,015 | 7,364,255 |
| 7,357,476 | 11/003,614 | 7,284,820 | 7,341,328 | 7,246,875 |
| 7,322,669 | 7,445,311 | 7,452,052 | 7,455,383 | 7,448,724 |
| 7,441,864 | 11/482,975 | 11/482,970 | 11/482,968 | 11/482,972 |
| 11/482,971 | 11/482,969 | 7,506,958 | 7,472,981 | 7,448,722 |
| 7,438,381 | 7,441,863 | 7,438,382 | 7,425,051 | 7,399,057 |
| 11/246,671 | 11/246,670 | 11/246,669 | 7,448,720 | 7,448,723 |
| 7,445,310 | 7,399,054 | 7,425,049 | 7,367,648 | 7,370,936 |
| 7,401,886 | 7,506,952 | 7,401,887 | 7,384,119 | 7,401,888 |
| 7,387,358 | 7,413,281 | 11/482,958 | 7,467,846 | 11/482,962 |
| 11/482,963 | 11/482,956 | 11/482,954 | 11/482,974 | 11/482,957 |
| 11/482,987 | 11/482,959 | 11/482,960 | 11/482,961 | 11/482,964 |
| 11/482,965 | 7,510,261 | 11/482,973 | 6,623,101 | 6,406,129 |
| 6,505,916 | 6,457,809 | 6,550,895 | 6,457,812 | 7,152,962 |
| 6,428,133 | 7,416,280 | 7,252,366 | 7,488,051 | 7,360,865 |
| 11/482,980 | 11/482,967 | 11/482,966 | 11/482,988 | 11/482,989 |
| 7,438,371 | 7,465,017 | 7,441,862 | 11/293,841 | 7,458,659 |
| 11/293,797 | 7,455,376 | 11/124,158 | 11/124,196 | 11/124,199 |
| 11/124,162 | 11/124,202 | 11/124,197 | 11/124,154 | 11/124,198 |
| 7,284,921 | 11/124,151 | 7,407,257 | 7,470,019 | 11/124,175 |
| 7,392,950 | 11/124,149 | 7,360,880 | 11/124,173 | 7,517,046 |
| 7,236,271 | 11/124,174 | 11/124,194 | 11/124,164 | 7,465,047 |
| 11/124,195 | 11/124,166 | 11/124,150 | 11/124,172 | 11/124,165 |
| 11/124,186 | 11/124,185 | 11/124,184 | 11/124,182 | 11/124,201 |
| 11/124,171 | 11/124,181 | 11/124,161 | 11/124,156 | 11/124,191 |
| 11/124,159 | 7,370,932 | 7,404,616 | 11/124,187 | 11/124,189 |

-continued

| | | | | |
|---|---|---|---|---|
| 11/124,190 | 7,500,268 | 11/124,193 | 7,447,908 | 11/124,178 |
| 11/124,177 | 7,456,994 | 7,431,449 | 7,466,444 | 11/124,179 |
| 11/124,169 | 11/187,976 | 11/188,011 | 11/188,014 | 11/482,979 |
| 11/228,540 | 11/228,500 | 11/228,501 | 11/228,530 | 11/228,490 |
| 11/228,531 | 11/228,504 | 11/228,533 | 11/228,502 | 11/228,507 |
| 11/228,482 | 11/228,505 | 11/228,497 | 11/228,487 | 11/228,529 |
| 11/228,484 | 7,499,765 | 11/228,518 | 11/228,536 | 11/228,496 |
| 11/228,488 | 11/228,506 | 11/228,516 | 11/228,526 | 11/228,539 |
| 11/228,538 | 11/228,524 | 11/228,523 | 7,506,802 | 11/228,528 |
| 11/228,527 | 7,403,797 | 11/228,520 | 11/228,498 | 11/228,511 |
| 11/228,522 | 11/228,515 | 11/228,537 | 11/228,534 | 11/228,491 |
| 11/228,499 | 11/228,509 | 11/228,492 | 11/228,493 | 11/228,510 |
| 11/228,508 | 11/228,512 | 11/228,514 | 11/228,494 | 7,438,215 |
| 11/228,486 | 11/228,481 | 11/228,477 | 7,357,311 | 7,380,709 |
| 7,428,986 | 7,403,796 | 7,407,092 | 11/228,513 | 11/228,503 |
| 7,469,829 | 11/228,535 | 11/228,478 | 11/228,479 | 6,238,115 |
| 6,386,535 | 6,398,344 | 6,612,240 | 6,752,549 | 6,805,049 |
| 6,971,313 | 6,899,480 | 6,860,664 | 6,925,935 | 6,966,636 |
| 7,024,995 | 7,284,852 | 6,926,455 | 7,056,038 | 6,869,172 |
| 7,021,843 | 6,988,845 | 6,964,533 | 6,981,809 | 7,284,822 |
| 7,258,067 | 7,322,757 | 7,222,941 | 7,284,925 | 7,278,795 |
| 7,249,904 | 6,746,105 | 11/246,687 | 11/246,718 | 7,322,681 |
| 11/246,686 | 11/246,703 | 11/246,691 | 7,510,267 | 7,465,041 |
| 11/246,712 | 7,465,032 | 7,401,890 | 7,401,910 | 7,470,010 |
| 11/246,702 | 7,431,432 | 7,465,037 | 7,445,317 | 11/246,699 |
| 11/246,675 | 11/246,674 | 11/246,667 | 7,156,508 | 7,159,972 |
| 7,083,271 | 7,165,834 | 7,080,894 | 7,201,469 | 7,090,336 |
| 7,156,489 | 7,413,283 | 7,438,385 | 7,083,257 | 7,258,422 |
| 7,255,423 | 7,219,980 | 10/760,253 | 7,416,274 | 7,367,649 |
| 7,118,192 | 10/760,194 | 7,322,672 | 7,077,505 | 7,198,354 |
| 7,077,504 | 10/760,189 | 7,198,355 | 7,401,894 | 7,322,676 |
| 7,152,959 | 7,213,906 | 7,178,901 | 7,222,938 | 7,108,353 |
| 7,104,629 | 7,455,392 | 7,370,939 | 7,429,095 | 7,404,621 |
| 7,261,401 | 7,461,919 | 7,438,388 | 7,328,972 | 7,303,930 |
| 7,401,405 | 7,464,466 | 7,464,465 | 7,246,886 | 7,128,400 |
| 7,108,355 | 6,991,322 | 7,287,836 | 7,118,197 | 10/728,784 |
| 7,364,269 | 7,077,493 | 6,962,402 | 10/728,803 | 7,147,308 |
| 7,524,034 | 7,118,198 | 7,168,790 | 7,172,270 | 7,229,155 |
| 6,830,318 | 7,195,342 | 7,175,261 | 7,465,035 | 7,108,356 |
| 7,118,202 | 7,510,269 | 7,134,744 | 7,510,270 | 7,134,743 |
| 7,182,439 | 7,210,768 | 7,465,036 | 7,134,745 | 7,156,484 |
| 7,118,201 | 7,111,926 | 7,431,433 | 7,018,021 | 7,401,901 |
| 7,468,139 | 11/188,017 | 7,128,402 | 7,387,369 | 7,484,832 |
| 11/097,308 | 7,448,729 | 7,246,876 | 7,431,431 | 7,419,249 |
| 7,377,623 | 7,328,978 | 7,334,876 | 7,147,306 | 11/482,953 |
| 11/482,977 | 09/575,197 | 7,079,712 | 6,825,945 | 7,330,974 |
| 6,813,039 | 6,987,506 | 7,038,797 | 6,980,318 | 6,816,274 |
| 7,102,772 | 7,350,236 | 6,681,045 | 6,728,000 | 7,173,722 |
| 7,088,459 | 09/575,181 | 7,068,382 | 7,062,651 | 6,789,194 |
| 6,789,191 | 6,644,642 | 6,502,614 | 6,622,999 | 6,669,385 |
| 6,549,935 | 6,987,573 | 6,727,996 | 6,591,884 | 6,439,706 |
| 6,760,119 | 7,295,332 | 6,290,349 | 6,428,155 | 6,785,016 |
| 6,870,966 | 6,822,639 | 6,737,591 | 7,055,739 | 7,233,320 |
| 6,830,196 | 6,832,717 | 6,957,768 | 7,456,820 | 7,170,499 |
| 7,106,888 | 7,123,239 | 10/727,181 | 10/727,162 | 7,377,608 |
| 7,399,043 | 7,121,639 | 7,165,824 | 7,152,942 | 10/727,157 |
| 7,181,572 | 7,096,137 | 7,302,592 | 7,278,034 | 7,188,282 |
| 10/727,159 | 10/727,180 | 10/727,179 | 10/727,192 | 10/727,274 |
| 10/727,164 | 7,523,111 | 10/727,198 | 10/727,158 | 10/754,536 |
| 10/754,938 | 10/727,160 | 10/934,720 | 7,171,323 | 7,278,697 |
| 7,360,131 | 7,369,270 | 6,795,215 | 7,070,098 | 7,154,638 |
| 6,805,419 | 6,859,289 | 6,977,751 | 6,398,332 | 6,394,573 |
| 6,622,923 | 6,747,760 | 6,921,144 | 10/884,881 | 7,092,112 |
| 7,192,106 | 7,457,001 | 7,173,739 | 6,986,560 | 7,008,033 |
| 11/148,237 | 7,222,780 | 7,270,391 | 7,525,677 | 11/482,981 |
| 7,195,328 | 7,182,422 | 7,374,266 | 7,427,117 | 7,448,707 |
| 7,281,330 | 10/854,503 | 7,328,956 | 10/854,509 | 7,188,928 |
| 7,093,989 | 7,377,609 | 10/854,495 | 10/854,498 | 10/854,511 |
| 7,390,071 | 10/854,525 | 10/854,526 | 10/854,516 | 7,252,353 |
| 10/854,515 | 7,267,417 | 10/854,505 | 7,517,036 | 7,275,805 |
| 7,314,261 | 10/854,490 | 7,281,777 | 7,290,852 | 7,484,831 |
| 10/854,523 | 10/854,527 | 10/854,524 | 10/854,520 | 10/854,514 |
| 10/854,519 | 10/854,513 | 10/854,499 | 10/854,501 | 7,266,661 |
| 7,243,193 | 10/854,518 | 10/934,628 | 7,163,345 | 7,465,033 |
| 7,452,055 | 7,470,002 | 11/293,833 | 7,475,963 | 7,448,735 |
| 7,465,042 | 7,448,739 | 7,438,399 | 11/293,794 | 7,467,853 |
| 7,461,922 | 7,465,020 | 11/293,830 | 7,461,910 | 11/293,828 |
| 7,270,494 | 11/293,823 | 7,475,961 | 11/293,831 | 11/293,815 |
| 11/293,819 | 11/293,818 | 11/293,817 | 11/293,816 | 11/482,978 |

-continued

| | | | | |
|---|---|---|---|---|
| 7,448,734 | 7,425,050 | 7,364,263 | 7,201,468 | 7,360,868 |
| 7,234,802 | 7,303,255 | 7,287,846 | 7,156,511 | 10/760,264 |
| 7,258,432 | 7,097,291 | 10/760,222 | 10/760,248 | 7,083,273 |
| 7,367,647 | 7,374,355 | 7,441,880 | 10/760,205 | 10/760,206 |
| 7,513,598 | 10/760,270 | 7,198,352 | 7,364,264 | 7,303,251 |
| 7,201,470 | 7,121,655 | 7,293,861 | 7,232,208 | 7,328,985 |
| 7,344,232 | 7,083,272 | 7,261,400 | 7,461,914 | 7,431,441 |
| 11/014,764 | 11/014,763 | 7,331,663 | 7,360,861 | 7,328,973 |
| 7,427,121 | 7,407,262 | 7,303,252 | 7,249,822 | 11/014,762 |
| 7,311,382 | 7,360,860 | 7,364,257 | 7,390,075 | 7,350,896 |
| 7,429,096 | 7,384,135 | 7,331,660 | 7,416,287 | 7,488,052 |
| 7,322,684 | 7,322,685 | 7,311,381 | 7,270,405 | 7,303,268 |
| 7,470,007 | 7,399,072 | 7,393,076 | 11/014,750 | 11/014,749 |
| 7,249,833 | 7,524,016 | 7,490,927 | 7,331,661 | 7,524,043 |
| 7,300,140 | 7,357,492 | 7,357,493 | 11/014,766 | 7,380,902 |
| 7,284,816 | 7,284,845 | 7,255,430 | 7,390,080 | 7,328,984 |
| 7,350,913 | 7,322,671 | 7,380,910 | 7,431,424 | 7,470,006 |
| 11/014,732 | 7,347,534 | 7,441,865 | 7,469,989 | 7,367,650 |
| 7,469,990 | 7,441,882 | 11/293,822 | 11/293,812 | 7,357,496 |
| 7,467,863 | 7,431,440 | 7,431,443 | 11/293,811 | 7,524,023 |
| 7,513,603 | 7,467,852 | 7,465,045 | 11/482,982 | 11/482,983 |
| 11/482,984 | | | | |

The disclosures of these applications and patents are incorporated herein by reference. Some of the above applications have been identified by their filing docket number, which will be substituted with the corresponding application number, once assigned.

BACKGROUND OF THE INVENTION

Inkjet printing is a popular and versatile form of print imaging. The Assignee has developed printers that eject ink through MEMS printhead IC's. These printhead IC's (integrated circuits) are formed using lithographic etching and deposition techniques used for semiconductor fabrication.

The micro-scale nozzle structures in MEMS printhead IC's allow a high nozzle density (nozzles per unit of IC surface area), high print resolutions, low power consumption, self cooling operation and therefore high print speeds. Such printheads are described in detail in U.S. Pat. No. 6,746,105, filed Jun. 4, 2002 and U.S. patent application Ser. No. 10/728,804 , filed 8 Dec. 2003 to the present Assignee. The disclosures of these documents are incorporated herein by reference.

The small nozzle structures and high nozzle densities can create difficulties with nozzle clogging, de-priming, nozzle drying (decap), color mixing, nozzle flooding, bubble contamination in the ink stream and so on. Each of these issues can produce artifacts that are detrimental to the print quality. The component parts of the printer are designed to minimize the risk that these problems will occur. The optimum situation would be printer components whose inherent function is able to preclude these problem issues from arising. In reality, the many different types of operating conditions, mishaps, unduly rough handling during transport or day to day operation, make it impossible to address the above problems via the 'passive' control of component design, material selection and so on.

SUMMARY OF THE INVENTION

According to a first aspect, the present invention provides an inkjet printer comprising:

a printhead IC with and array of ink ejection nozzles;

an ink manifold for distributing ink to the printhead IC, the ink manifold having an ink inlet and an ink outlet;

an upstream pump in fluid communication with the ink inlet; and, a downstream pump in fluid communication with the ink outlet; wherein, the upstream pump and the downstream pump are independently operable.

With a pump at the inlet and the outlet of the manifold the user can actively control the ink flows though the printer and use this control for ink purges, de-priming, re-priming and ink pressure regulation. Actively priming and de-priming the ink manifold provides the user with the ability to correct many of the problems associated with MEMS printheads after they occur. In light of this, it is not as crucial that the printer components themselves safeguard against issues such as de-prime, color mixing and outgassing. An active control system for the ink flow through the printer means that the user can prime, deprime, or purge the printhead IC. Also, the upstream line can be deprimed and/or the downstream line can be deprimed (and of course subsequently re-primed). This control system allows the user to correct and print artifact causing conditions as and when they occur.

Preferably, the printer further comprises a gas inlet that can be opened to establish fluid communication between the ink manifold and a supply of gas, and can be closed to form a gas tight seal; such that, the ink manifold can be primed with ink when the gas inlet is closed, and de-primed of ink when the gas inlet is open.

The manifold and the printhead IC can be deprimed by shutting off the upstream pump and operating the downstream pump to draw air in through the ink ejection nozzles. However, a gas inlet upstream of the manifold will allow ink to be retained in the printhead IC. This is useful for creating an ink foam on the face of the printhead IC to clean particulates from the nozzles (this is discussed further in the Detailed Description below). De-priming by drawing air in through an inlet rather than the ejection nozzles leaves more residual ink in the printhead IC for forming the ink foam.

Preferably, the printer further comprises an ink supply is connected to the inlet of the ink manifold via an upstream ink line, and the downstream pump connected to the ink manifold via a downstream ink line. In a preferred embodiment, the gas inlet is an air inlet which can open to atmosphere. In preferred embodiments, the hydrostatic pressure in the ink at the ink ejection nozzle is less than atmospheric. In a further preferred form, the upstream and downstream pumps are reversible for pumping ink in a reverse direction. Preferably, the downstream ink line connects the ink manifold to the ink supply via the downstream pump and the outlet of the ink manifold is in fluid communication with a gas vent for gas drawn into the ink manifold during depriming. Optionally, the gas vent is in the ink supply.

Preferably, the upstream and the downstream pumps are peristaltic pumps. Optionally, the upstream pump and the downstream pumps are provided by a six-way peristaltic pump head driven by a single motor. Optionally, the upstream pump and the downstream pump are driven by separate motors. If the printer only has a single pump, the pump may be a three-way peristaltic pump head. Preferably, the upstream ink line has a pressure regulator that allows ink to flow to the ink manifold at a predetermined threshold pressure difference across the pressure regulator. Preferably, the printer further comprises a capping member for sealing the array of nozzles on the printhead IC.

Preferably, the printer is a color printer with a separate ink supplies for each ink color, and respective inlets and outlets for each ink color in the ink manifold.

Preferably, the printhead IC is a pagewidth printhead and the ink manifold is an elongate structure with the inlet at one end and the outlet at the opposite end. In one preferred form, the upstream pump and the downstream pump can operate at different flow rates. Optionally, the upstream pump and the downstream pump can act as shout off valves in the upstream and down stream lines respectively. Preferably, the printer further comprises an ink filter upstream of the ink manifold for removing bubbles and contaminants from ink flowing to the manifold.

It will be appreciated that the term 'ink', when used throughout this specification, refers to all types of printable fluid and is not limited to liquid colorants. Infrared inks and other types of functionalized fluids are encompassed by the term 'ink' as well as the cyan, magenta, yellow and possibly black inks that are typically used by inkjet printers.

According to a second aspect, the present invention provides an inkjet printer comprising:

an ink supply;

an ink manifold in fluid communication with the ink supply;

a printhead IC with and array of ink ejection nozzles mounted to the ink manifold;

a pump in fluid communication with the ink manifold; and, a gas inlet that can be opened to establish fluid communication between the ink manifold and a supply of gas, and can be closed to form a gas tight seal; such that, the ink manifold can be primed with ink when the gas inlet is closed, and de-primed of ink when the gas inlet is open.

Actively priming and de-priming the ink manifold provides the user with the ability to correct many of the problems associated with MEMS printheads after they occur. In light of this, it is not as crucial that the printer components themselves safeguard against issues such as de-prime, color mixing and outgassing. An active control system for the ink flow through the printer means that the user can prime, deprime, or purge the printhead IC. Also, the upstream line can be deprimed and/or the downstream line can be deprimed (and of course subsequently re-primed). This control system allows the user to correct and print artifact causing conditions as and when they occur.

Preferably, the ink supply is connected to the ink manifold via an upstream ink line, and the pump is a downstream pump connected to the ink manifold via a downstream ink line. In a further preferred form, the printer further comprises an upstream pump in the upstream ink line. In a preferred embodiment, the gas inlet is an air inlet which can open to atmosphere. In preferred embodiments, the manifold has an inlet connected to the upstream ink line and an outlet connected to the downstream ink line such that when priming the ink manifold, the hydrostatic pressure in the ink at the ink ejection nozzle is less than atmospheric.

Preferably, the upstream and downstream pumps are independently operable. In a further preferred form, the upstream and downstream pumps are reversible for pumping ink in a reverse direction. Preferably, the downstream ink line connects the ink manifold to the ink supply via the downstream pump and the outlet of the ink manifold is in fluid communication with a gas vent for gas drawn into the ink manifold during depriming. Optionally, the gas vent is in the ink supply.

Preferably, the upstream and the downstream pumps are peristaltic pumps. Optionally, the upstream pump and the downstream pumps are provided by a six-way peristaltic pump head driven by a single motor. Optionally, the upstream pump and the downstream pump are driven by separate motors. If the printer only has a single pump, the pump may be a three-way peristaltic pump head. Preferably, the upstream ink line has a pressure regulator that allows ink to flow to the ink manifold at a predetermined threshold pressure difference across the pressure regulator. Preferably, the printer further comprises a capping member for sealing the array of nozzles on the printhead IC.

Preferably, the printer is a color printer with a separate ink supplies for each ink color, and respective inlets and outlets for each ink color in the ink manifold.

Preferably, the printhead IC is a pagewidth printhead and the ink manifold is an elongate structure with the inlet at one end and the outlet at the opposite end. In one preferred form, the upstream pump and the downstream pump can operate at different flow rates. Optionally, the upstream pump and the downstream pump can act as shout off valves in the upstream and down stream lines respectively. Preferably, the printer further comprises an ink filter upstream of the ink manifold for removing bubbles and contaminants from ink flowing to the manifold.

It will be appreciated that the term 'ink', when used throughout this specification, refers to all types of printable fluid and is not limited to liquid colorants. Infrared inks and other types of functionalized fluids are encompassed by the term 'ink' as well as the cyan, magenta, yellow and possibly black inks that are typically used by inkjet printers.

BRIEF DESCRIPTION OF THE DRAWINGS

Preferred embodiments of the invention will now be described by way of example only with reference to the accompanying drawings, in which.

DETAILED DESCRIPTION OF PREFERRED EMBODIMENTS

The printers using prior art types of fluid architecture are exemplified by the disclosure in the Assignee's co-pending U.S. patent application Ser. No. 11/014,769 (Docket No. RRC001US), filed Dec. 20, 2004, which is incorporated herein by cross reference. For context, the printhead assembly from this printer design will be described before the embodiments of the present invention.

Printhead Assembly

Figure 10:
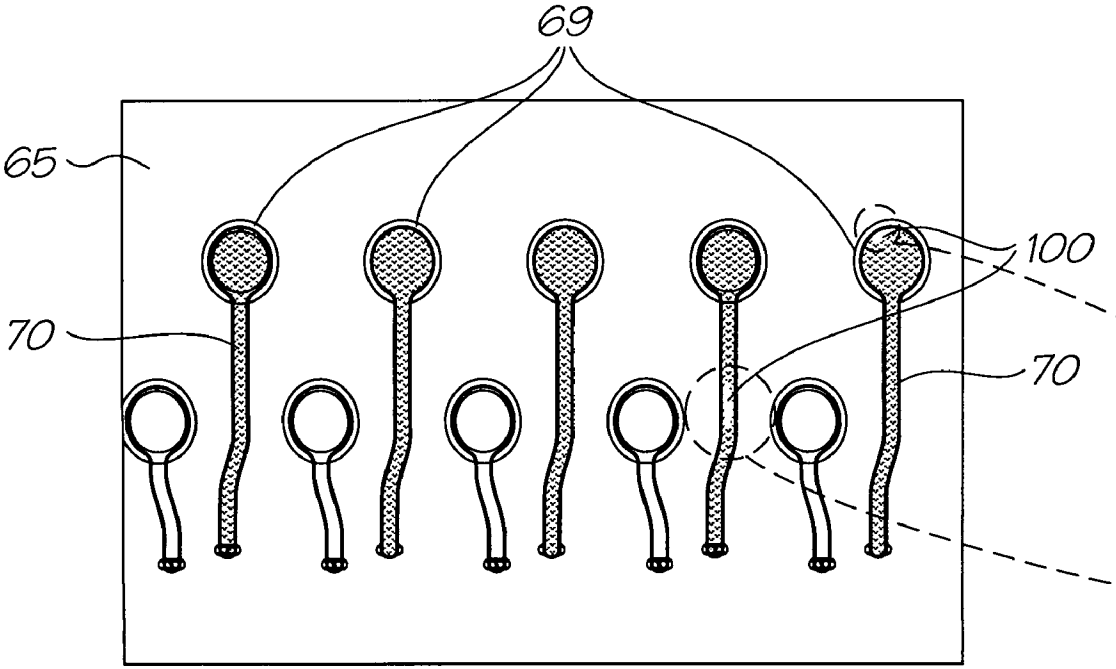
FIG. 10 shows the fine conduits in the underside of the LCP manifold.

The printhead assembly 22 shown in FIGS. 1 to 4 is adapted to be attached to the underside of the main body 20 to receive ink from the outlets molding 27 (see FIG. 10 of U.S. Ser. No. 11/014,769 cross referenced above).

The printhead assembly 22 generally comprises an ink manifold that receives ink from the ink cartridges, or ink storage modules 45 as they are referred to in U.S. Ser. No. 11/014,769, and distributes it to the printhead integrated circuits (IC's). The ink manifold is made up of an elongate upper member 62 fixed to an elongate lower member 65. The upper member 62 is configured to extend beneath the main body 20, between the posts 26. A plurality of U-shaped clips 63 project from the upper member 62. These pass through the recesses 37 provided in the rigid plate 34 and become captured by lugs (not shown) formed in the main body 20 to secure the printhead assembly 22.

The upper element 62 has a plurality of feed tubes 64 that are received within the outlets in the outlet molding 27 when the printhead assembly 22 secures to the main body 20. The feed tubes 64 may be provided with an outer coating to guard against ink leakage.

The upper member 62 is made from a liquid crystal polymer (LCP) which offers a number of advantages. It can be molded so that its coefficient of thermal expansion (CTE) is similar to that of silicon. It will be appreciated that any significant difference in the CTE's of the printhead integrated circuit 74 (discussed below) and the underlying moldings can cause the entire structure to bow. However, as the CTE of LCP in the mold direction is much less than that in the non-mold direction (~5 ppm/° C. compared to ~20 ppm/° C.), care must be take to ensure that the mold direction of the LCP moldings is unidirectional with the longitudinal extent of the printhead integrated circuit (IC) 74. LCP also has a relatively high stiffness with a modulus that is typically 5 times that of 'normal plastics' such as polycarbonates, styrene, nylon, PET and polypropylene.

Figure 1:
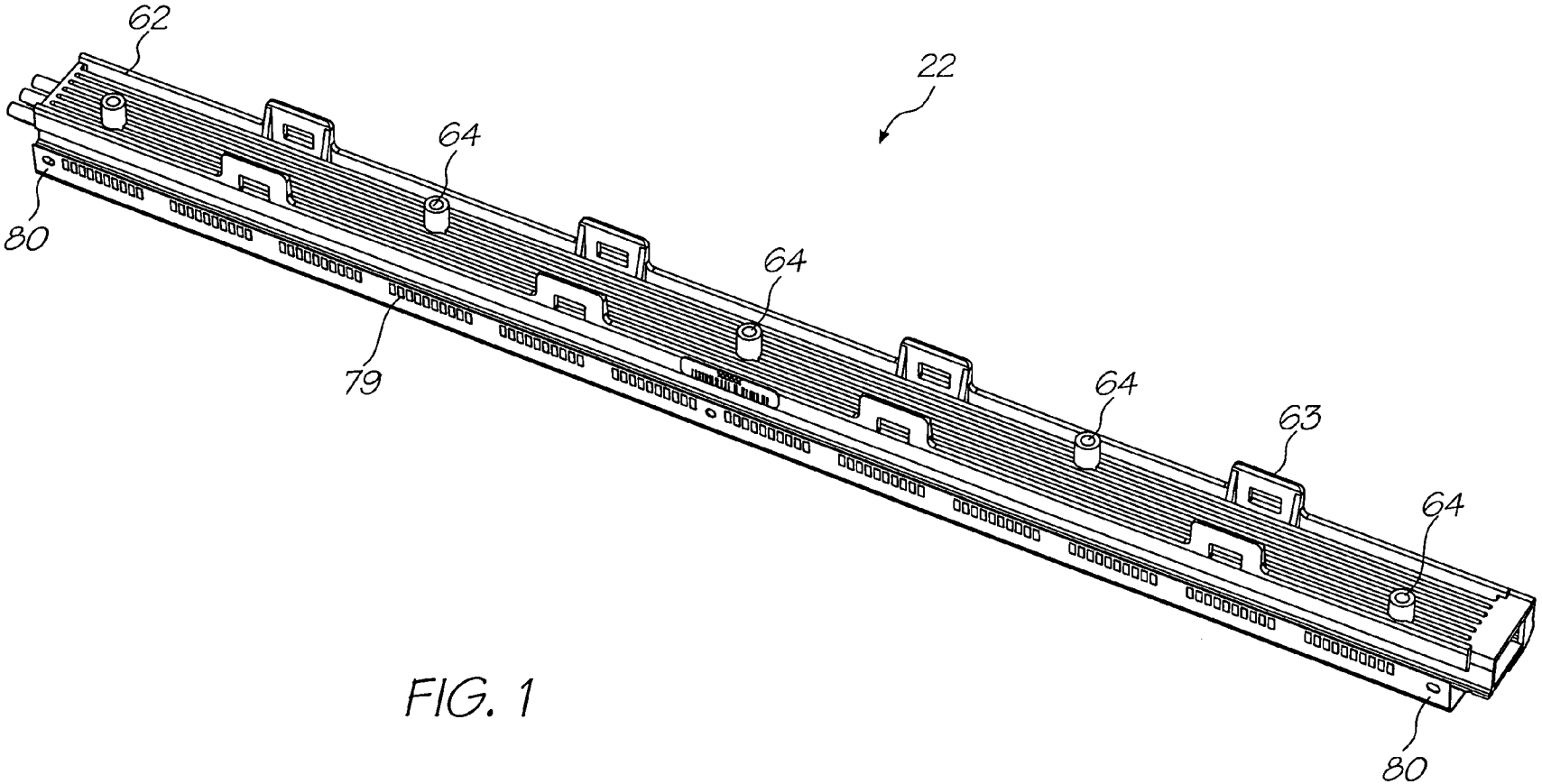
FIG. 1 is a top and side perspective of a printhead assembly using a LCP ink manifold according to the prior art.
Figure 2:
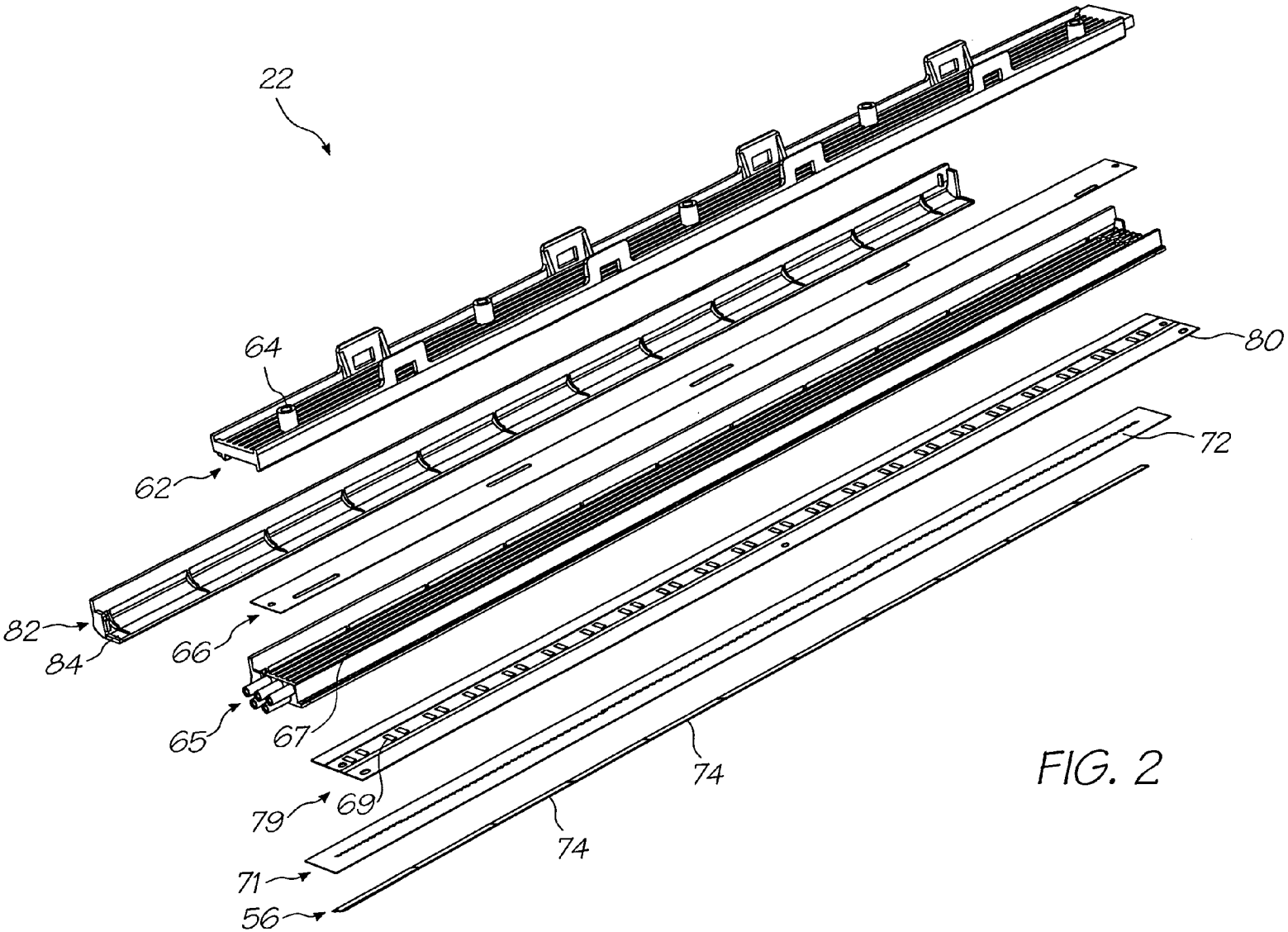
FIG. 2 is an exploded perspective of the printhead assembly shown in FIG. 1.

As best shown in FIG. 2, upper member 62 has an open channel configuration for receiving a lower member 65, which is bonded thereto, via an adhesive film 66. The lower member 65 is also made from an LCP and has a plurality of ink channels 67 formed along its length. Each of the ink channels 67 receive ink from one of the feed tubes 64, and distribute the ink along the length of the printhead assembly 22. The channels are 1 mm wide and separated by 0.75 mm thick walls.

In the embodiment shown, the lower member 65 has five channels 67 extending along its length. Each channel 67 receives ink from only one of the five feed tubes 64, which in turn receives ink from one of the ink storage modules 45 (see FIG. 10 of U.S. Ser. No. 11/014,769 cross referenced above). In this regard, adhesive film 66 also acts to seal the individual ink channels 67 to prevent cross channel mixing of the ink when the lower member 65 is assembled to the upper member 62.

Figure 8:
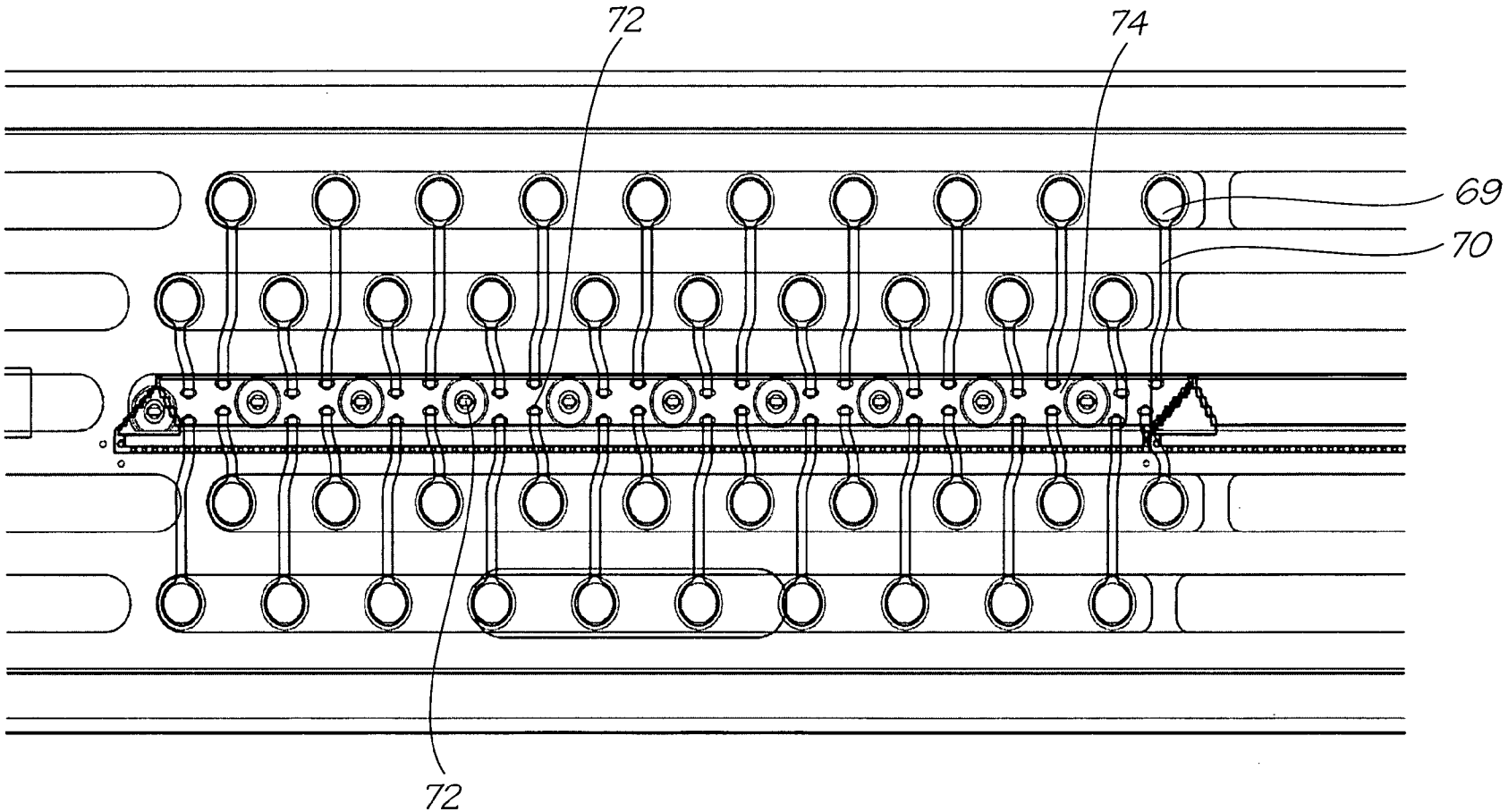
FIG. 8 is a partial bottom view of the LCP manifold and the printhead IC.

In the bottom of each channel 67 are a series of equi-spaced holes 69 (best seen in FIG. 3) to give five rows of holes 69 in the bottom surface of the lower member 65. The middle row of holes 69 extends along the centre-line of the lower member 65, directly above the printhead IC 74. As best seen in FIG. 8, other rows of holes 69 on either side of the middle row need conduits 70 from each hole 69 to the centre so that ink can be fed to the printhead IC 74.

Figure 3:
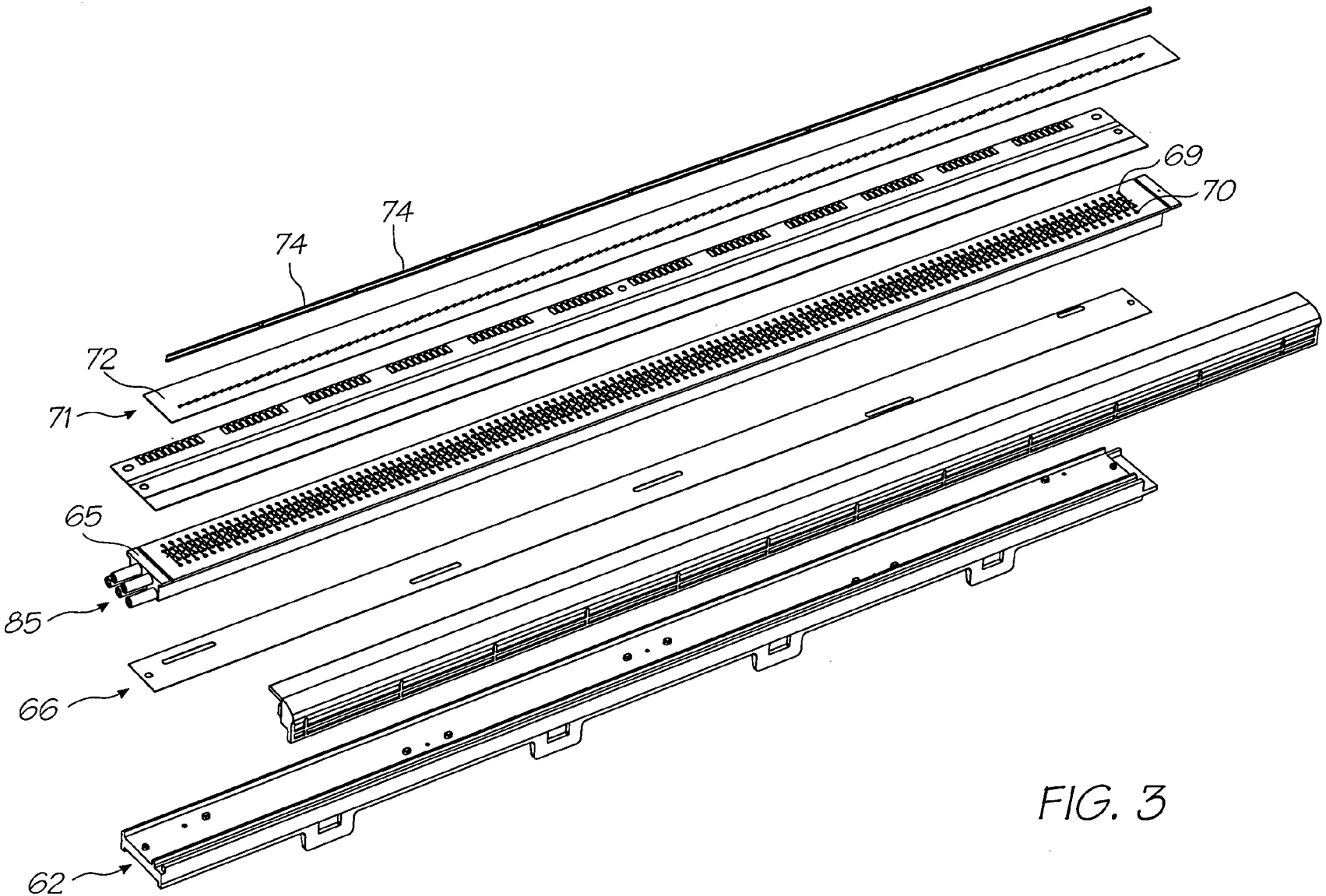
FIG. 3 is the exploded perspective of FIG. 2 shown from below.
Figure 4:
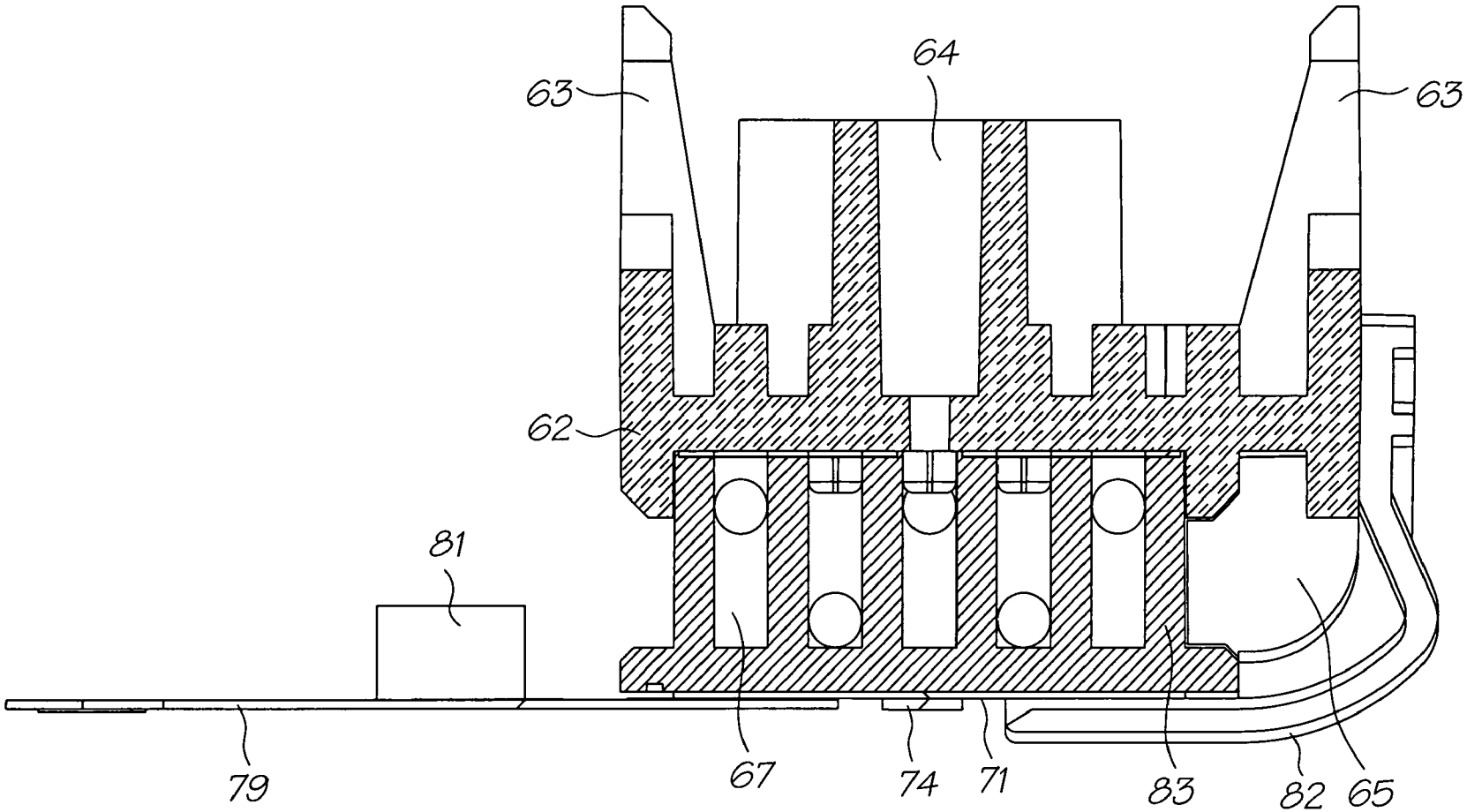
FIG. 4 is transverse section through the printhead assembly of FIG. 1.
Figure 9:
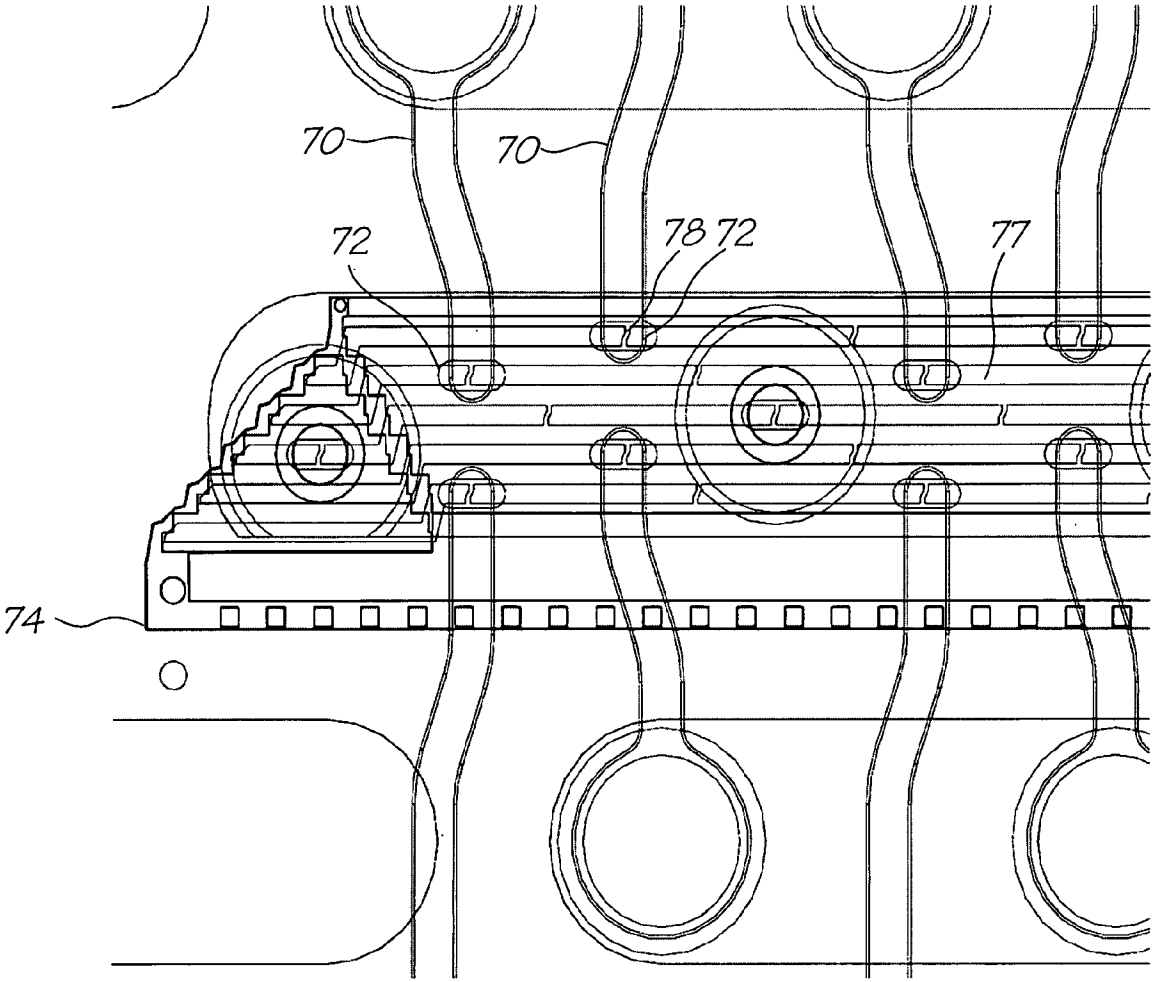
FIG. 9 is an enlarged partial bottom view of the LCP manifold and the printhead IC.

Referring to FIG. 4, the printhead IC 74 is mounted to the underside of the lower member 65 by a polymer sealing film 71. This film may be a thermoplastic film such as a PET or Polysulphone film, or it may be in the form of a thermoset film, such as those manufactured by AL technologies and Rogers Corporation. The polymer sealing film 71 is a laminate with adhesive layers on both sides of a central film, and laminated onto the underside of the lower member 65. As shown in FIGS. 3, 8 and 9, a plurality of holes 72 are laser drilled through the adhesive film 71 to coincide with the centrally disposed ink delivery points (the middle row of holes 69 and the ends of the conduits 70) for fluid communication between the printhead IC 74 and the channels 67.

Figure 7:
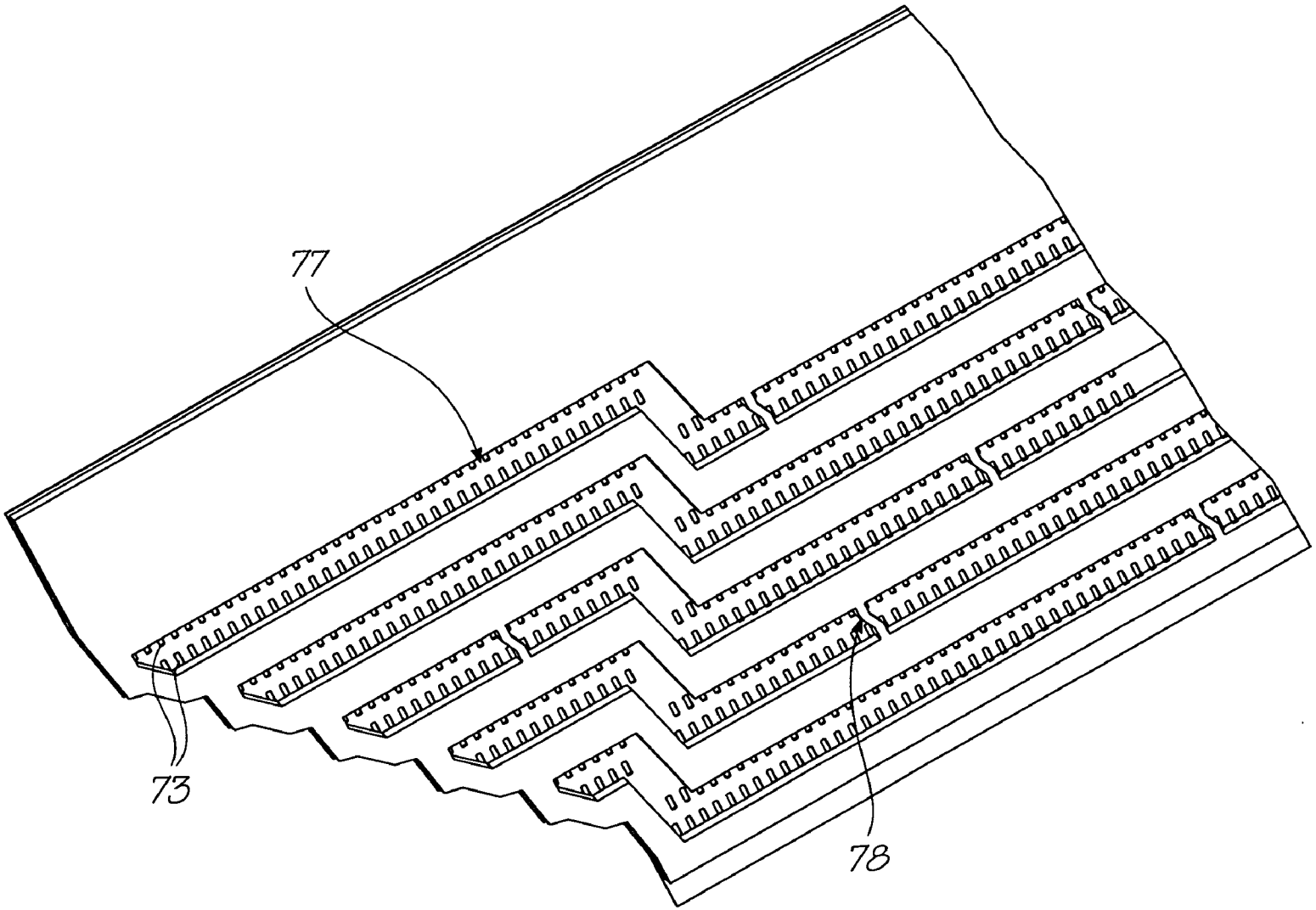
FIG. 7 shows a magnified partial perspective view of the top of the drop triangle end of a printhead integrated circuit module.

The thickness of the polymer sealing film 71 is critical to the effectiveness of the ink seal it provides. As best seen in FIGS. 7 and 8, the polymer sealing film seals the etched channels 77 on the reverse side of the printhead IC 74, as well as the conduits 70 on the other side of the film. However, as the film 71 seals across the open end of the conduits 70, it can also bulge or sag into the conduit. The section of film that sags into a conduit 70 runs across several of the etched channels 77 in the printhead IC 74. The sagging may cause a gap between the walls separating each of the etched channels 77. Obviously, this breaches the seal and allows ink to leak out of the printhead IC 74 and or between etched channels 77.

To guard against this, the polymer sealing film 71 should be thick enough to account for any sagging into the conduits 70 while maintaining the seal over the etched channels 77. The minimum thickness of the polymer sealing film 71 will depend on:

1. the width of the conduit into which it sags;
2. the thickness of the adhesive layers in the film's laminate structure;
3. the 'stiffness' of the adhesive layer as the printhead IC 74 is being pushed into it; and,
4. the modulus of the central film material of the laminate.

A polymer sealing film 71 thickness of 25 microns is adequate for the printhead assembly 22 shown. However, increasing the thickness to 50, 100 or even 200 microns will correspondingly increase the reliability of the seal provided.

Ink delivery inlets 73 are formed in the 'front' surface of a printhead IC 74. The inlets 73 supply ink to respective nozzles (described in FIGS. 23 to 36 of U.S. Ser. No. 11/014,769 cross referenced above) positioned on the inlets. The ink must be delivered to the IC's so as to supply ink to each and every individual inlet 73. Accordingly, the inlets 73 within an individual printhead IC 74 are physically grouped to reduce ink supply complexity and wiring complexity. They are also grouped logically to minimize power consumption and allow a variety of printing speeds.

Figure 5:
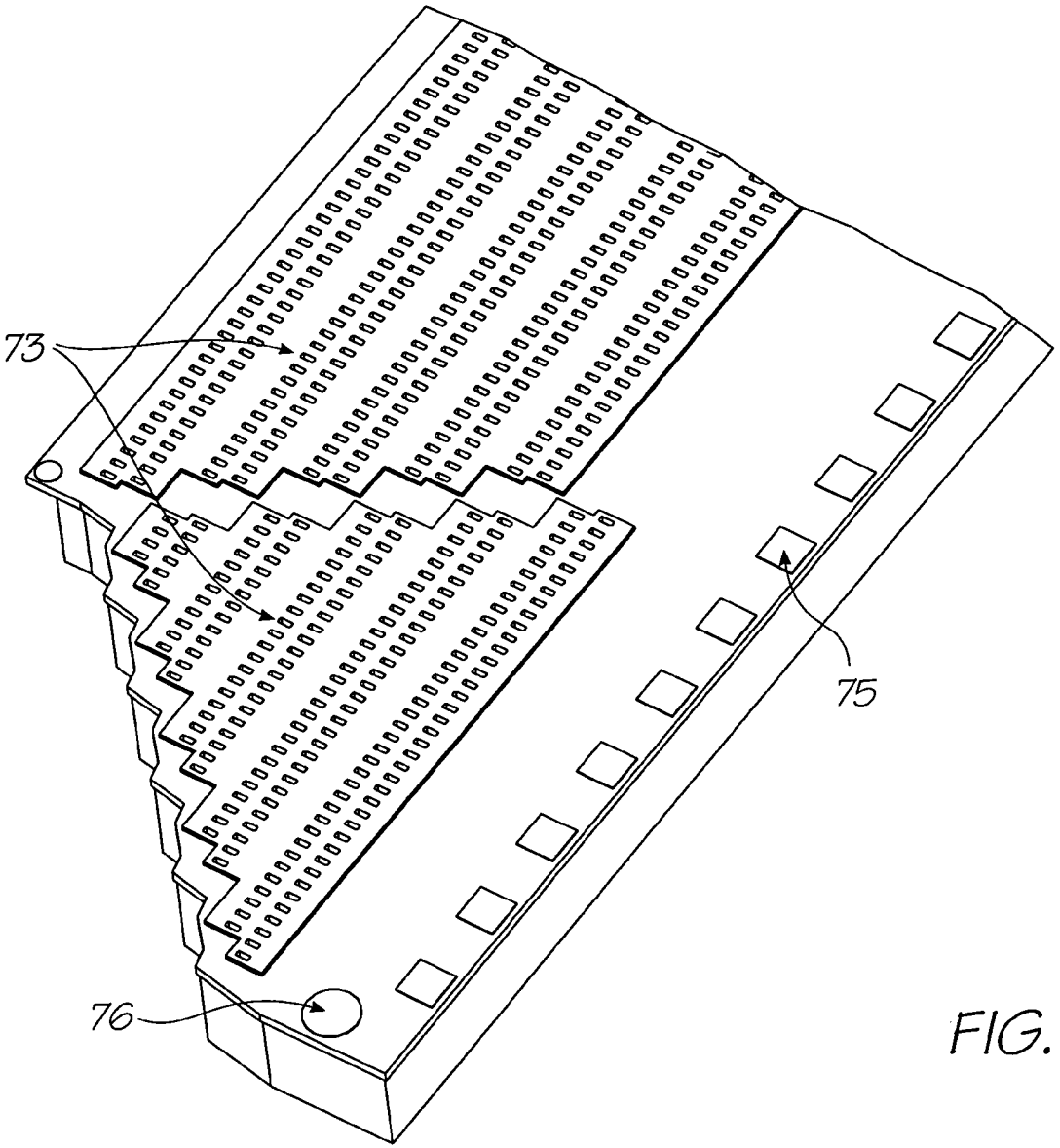
FIG. 5 shows a magnified partial perspective view of the bottom of the drop triangle end of a printhead integrated circuit module.

Each printhead IC 74 is configured to receive and print five different colours of ink (C, M, Y, K and IR) and contains 1280 ink inlets per colour, with these nozzles being divided into even and odd nozzles (640 each). Even and odd nozzles for each colour are provided on different rows on the printhead IC 74 and are aligned vertically to perform true 1600 dpi printing, meaning that nozzles 801 are arranged in 10 rows, as clearly shown in FIG. 5. The horizontal distance between two adjacent nozzles 801 on a single row is 31.75 microns, whilst the vertical distance between rows of nozzles is based on the firing order of the nozzles, but rows are typically separated by an exact number of dot lines, plus a fraction of a dot line corresponding to the distance the paper will move between row firing times. Also, the spacing of even and odd rows of nozzles for a given colour must be such that they can share an ink channel, as will be described below.

As alluded to previously, the present invention is related to page-width printing and as such the printhead ICs 74 are arranged to extend horizontally across the width of the printhead assembly 22. To achieve this, individual printhead ICs 74 are linked together in abutting arrangement across the surface of the adhesive layer 71, as shown in FIGS. 2 and 3. The printhead IC's 74 may be attached to the polymer sealing film 71 by heating the IC's above the melting point of the adhesive layer and then pressing them into the sealing film 71, or melting the adhesive layer under the IC with a laser before pressing them into the film. Another option is to both heat the IC (not above the adhesive melting point) and the adhesive layer, before pressing it into the film 71.

The length of an individual printhead IC 74 is around 20-22 mm. To print an A4/US letter sized page, 11-12 individual printhead ICs 74 are contiguously linked together. The number of individual printhead ICs 74 may be varied to accommodate sheets of other widths.

Figure 6:
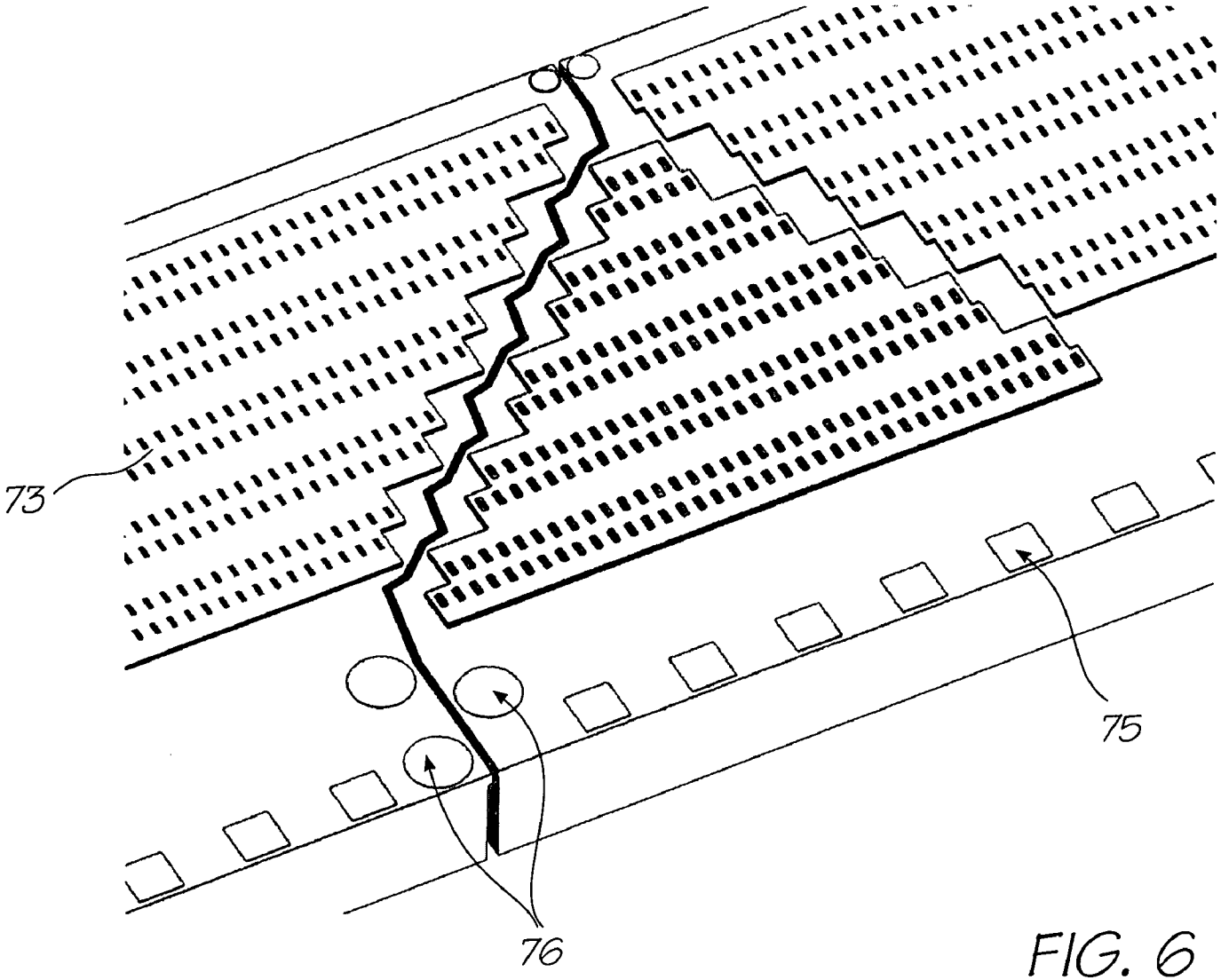
FIG. 6 shows a magnified perspective view of the join between two printhead integrated circuit modules.

The printhead ICs 74 may be linked together in a variety of ways. One particular manner for linking the ICs 74 is shown in FIG. 6. In this arrangement, the ICs 74 are shaped at their ends to link together to form a horizontal line of ICs, with no vertical offset between neighboring ICs. A sloping join is provided between the ICs having substantially a 45° angle. The joining edge is not straight and has a sawtooth profile to facilitate positioning, and the ICs 74 are intended to be spaced about 11 microns apart, measured perpendicular to the joining edge. In this arrangement, the left most ink delivery nozzles 73 on each row are dropped by 10 line pitches and arranged in a triangle configuration. This arrangement provides a degree of overlap of nozzles at the join and maintains the pitch of the nozzles to ensure that the drops of ink are delivered consistently along the printing zone. This arrangement also ensures that more silicon is provided at the edge of the IC 74 to ensure sufficient linkage. Whilst control of the operation of the nozzles is performed by the SoPEC device (discussed later in of U.S. Ser. No. 11/014,769 cross referenced above), compensation for the nozzles may be performed in the printhead, or may also be performed by the SoPEC device, depending on the storage requirements. In this regard it will be appreciated that the dropped triangle arrangement of nozzles disposed at one end of the IC 74 provides the minimum on-printhead storage requirements. However where storage requirements are less critical, shapes other than a triangle can be used, for example, the dropped rows may take the form of a trapezoid.

The upper surface of the printhead ICs have a number of bond pads 75 provided along an edge thereof which provide a means for receiving data and or power to control the operation of the nozzles 73 from the SoPEC device. To aid in positioning the ICs 74 correctly on the surface of the adhesive layer 71 and aligning the ICs 74 such that they correctly align with the holes 72 formed in the adhesive layer 71, fiducials 76 are also provided on the surface of the ICs 74. The fiducials 76 are in the form of markers that are readily identifiable by appropriate positioning equipment to indicate the true position of the IC 74 with respect to a neighboring IC and the surface of the adhesive layer 71, and are strategically positioned at the edges of the ICs 74, and along the length of the adhesive layer 71.

In order to receive the ink from the holes 72 formed in the polymer sealing film 71 and to distribute the ink to the ink inlets 73, the underside of each printhead IC 74 is configured as shown in FIG. 7. A number of etched channels 77 are provided, with each channel 77 in fluid communication with a pair of rows of inlets 73 dedicated to delivering one particular colour or type of ink. The channels 77 are about 80 microns wide, which is equivalent to the width of the holes 72 in the polymer sealing film 71, and extend the length of the IC 74. The channels 77 are divided into sections by silicon walls 78. Each section is directly supplied with ink, to reduce the flow path to the inlets 73 and the likelihood of ink starvation to the individual nozzles. In this regard, each section feeds approximately 128 nozzles 801 via their respective inlets 73.

FIG. 9 shows more clearly how the ink is fed to the etched channels 77 formed in the underside of the ICs 74 for supply to the nozzles 73. As shown, holes 72 formed through the polymer sealing film 71 are aligned with one of the channels 77 at the point where the silicon wall 78 separates the channel 77 into sections. The holes 72 are about 80 microns in width which is substantially the same width of the channels 77 such that one hole 72 supplies ink to two sections of the channel 77. It will be appreciated that this halves the density of holes 72 required in the polymer sealing film 71.

Following attachment and alignment of each of the printhead ICs 74 to the surface of the polymer sealing film 71, a flex PCB 79 (see FIG. 4) is attached along an edge of the ICs 74 so that control signals and power can be supplied to the bond pads 75 to control and operate the nozzles. As shown more clearly in FIG. 1, the flex PCB 79 extends from the printhead assembly 22 and folds around the printhead assembly 22.

The flex PCB 79 may also have a plurality of decoupling capacitors 81 arranged along its length for controlling the power and data signals received. As best shown in FIG. 2, the flex PCB 79 has a plurality of electrical contacts 180 formed along its length for receiving power and or data signals from the control circuitry of the cradle unit 12. A plurality of holes 80 are also formed along the distal edge of the flex PCB 79 which provide a means for attaching the flex PCB to the flange portion 40 of the rigid plate 34 of the main body 20. The manner in which the electrical contacts of the flex PCB 79 contact the power and data contacts of the cradle unit 12 will be described later.

As shown in FIG. 4, a media shield 82 protects the printhead ICs 74 from damage which may occur due to contact with the passing media. The media shield 82 is attached to the upper member 62 upstream of the printhead ICs 74 via an appropriate clip-lock arrangement or via an adhesive. When attached in this manner, the printhead ICs 74 sit below the surface of the media shield 82, out of the path of the passing media.

A space 83 is provided between the media shield 82 and the upper 62 and lower 65 members which can receive pressurized air from an air compressor or the like. As this space 83 extends along the length of the printhead assembly 22, compressed air can be supplied to the space 56 from either end of the printhead assembly 22 and be evenly distributed along the assembly. The inner surface of the media shield 82 is provided with a series of fins 84 which define a plurality of air outlets evenly distributed along the length of the media shield 82 through which the compressed air travels and is directed across the printhead ICs 74 in the direction of the media delivery. This arrangement acts to prevent dust and other particulate matter carried with the media from settling on the surface of the printhead ICs, which could cause blockage and damage to the nozzles.

Active Ink Flow Control System

The present invention gives the user a versatile control system for correcting many of the detrimental conditions that are possible during the operative life of the printer. It is also capable of preparing the printhead for transport, long term storage and re-activation. It can also allow the user to establish a desired negative pressure at the printhead IC nozzles. The control system requires easily incorporated modifications to the prior art printer designs described above.

Printhead Maintenance Requirements

The printer's maintenance system should meet several requirements:

sealing for hydration
sealing to exclude particulates
drop ejection for hydration
drop ejection for ink purge
correction of dried nozzles
correction of flooding
correction of particulate fouling
correction of outgassing
correction of color mixing and
correction of deprime Various mechanisms and components within the printer assembly are designed with a view to minimizing any problems that the printhead maintenance system will need to address. However, it is unrealistic to expect that the design of the printer assembly components can deal with all the problems that arise for the printhead maintenance system. In relation to sealing the nozzle face for hydration and sealing the nozzles to exclude particulates the maintenance system can incorporate a capping member with a perimeter seal that will achieve these two requirements.

Drop ejection for hydration (or keep wet drops) and drop ejection for ink purge require the print engine controller (PEC) to play a roll in the overall printhead maintenance system.

The particulate fouling can be dealt with using filters positioned upstream of the printhead. However, care must be taken that small sized filters do not become too much of a flow constriction. By increasing the surface area of the filter the appropriate ink supply rate to the printhead can be maintained.

Correcting a flooded printhead will typically involve some type of blotting or wiping mechanism to remove beads of ink on the nozzle face of the printhead. Methods and systems for removing ink flooded across an ink ejection face of a printhead are described in our earlier filed U.S. application Ser No. 11/246,707 ("Printhead Maintenance Assembly with Film Transport of Ink"), Ser. No. 11/246,706 ("Method of Maintaining a Printhead using Film Transport of Ink"), Ser. No. 11/246,705 ("Method of Removing Ink from a Printhead using Film Transfer"), and Ser. No. 11/246,708 ("Method of Removing Particulates from a Printhead using Film Transfer"), all filed on Oct. 11, 2005. The contents of each of these U.S. applications are incorporated herein by reference.

Dried nozzles, outgassing, color mixing and nozzle deprime are more difficult to correct as they typically require a strong ink purge. Purging ink is relatively wasteful and creates an ink removal problem for the capping mechanism. Again the arrangements described in the above referenced U.S. applications incorporate an ink collection and transport to sump function.

Outgassing is a significant problem for printheads having micron scale fluid flow conduits. Outgassing occurs when gasses dissolved in the ink (typically nitrogen) come out of solution to form bubbles. These bubbles can lodge in the ink line or even the ink ejection chambers and prevent the downstream nozzles from ejecting.

FIG. 10 shows the underside of the LCP moulding 65. Conduits 69 extend between the point where the printed IC (not shown) is mounted and the holes 69. Bubbles from outgassing 100 form in the upstream ink line and feed down to the printed IC.

Figure 11:
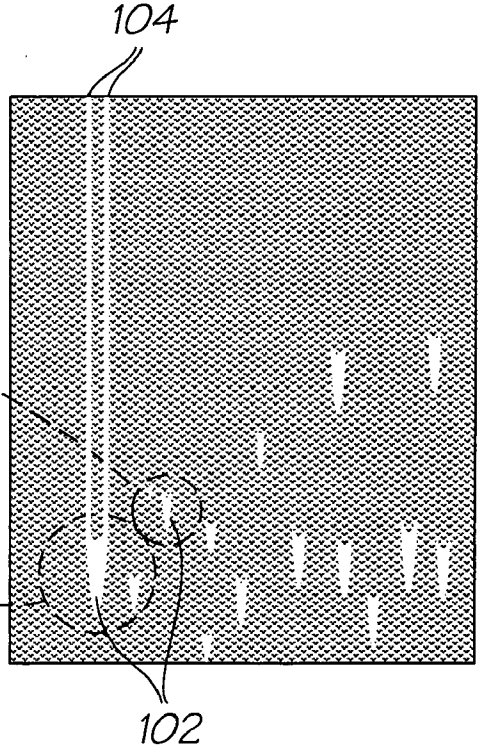
FIG. 11 shows the typical artifacts from outgassing bubbles forming in the LCP manifold and the printhead IC.

FIG. 11 shows the artifacts that result from outgassing bubbles. As the bubbles 100 feed into the printhead IC, the nozzles deprime and start ejecting the bubble gas rather than ink. This appears as arrow head shaped artifacts 102 in the resulting print. Hopefully pressure from upstream ink flow eventually clears the bubble from the printhead IC and the artifacts disappear. However, the bubbles 100 can have a tendency to get stuck at conduit discontinuities. Discontinuities such as the silicon wall 78 across the channel 77 in the printhead IC (see FIG. 9) tend to trap some of the bubbles and effectively form an ink blockage to nozzles fed from that end of the channel 77. These usually result in streak type artifacts 104 extending from the bottom corners of the arrow head artifact 102. There is a significant risk that these bubbles do not eventually clear with continued printing which can result in persistent artifacts or nozzle burn out from lack of ink cooling.

Another problem that is difficult to address using component design is color mixing. Color mixing occurs when ink of one color establishes a fluid connection with ink of another color via the face of the nozzle plate. Ink from one ink loan can be driven into the ink loan of a different color by slightly different hydraulic pressures within each line, osmotic pressure differences and even simple diffusion.

Capping and wiping the nozzle plate will remove the vast majority of particulates that create the fluid flow path between nozzles. However, printhead IC's with high nozzle densities require only a single piece of paper dust or thin surface film to create significant color mixing while the printer is left idle for hours or overnight.

Instead of placing a heavy reliance on the design of the printhead assembly components to deal with factors that give rise to printhead maintenance issues, the present invention uses an active control system for the printhead maintenance regime to correct issues as they arise.

Figure 12:
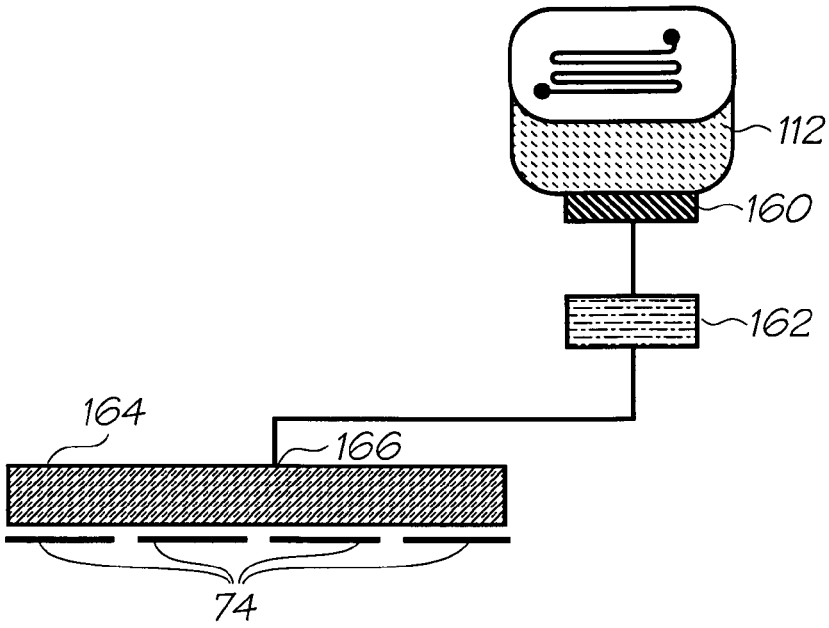
FIG. 12 (PRIOR ART)
FIG. 12 is a sketch of the fluidic system for a prior art printer.

FIG. 12 is a schematic representation of the fluid architecture for the printhead shown in FIGS. 1 to 11. The different ink colors are fed from respective ink tanks 112 to the LCP molding 164 via a filter 160 and pressure regulator 162. The inlet 166 to the LCP molding 164 is intermediate the ends of its elongate top molding to assist the ink to evenly fill the length of the channel 67 (see FIG. 10). From the channels 67, the ink is fed through holes to the smaller conduits 70 (see FIG. 10) that lead to the five separate printhead IC's 74. This architecture terminates the ink line at the printhead IC 74. Hence any attempts to change the ink flow conditions within the printhead IC 74 need to occur by intervention upstream.

Actively Controlled Flow Conditions

Figure 13:
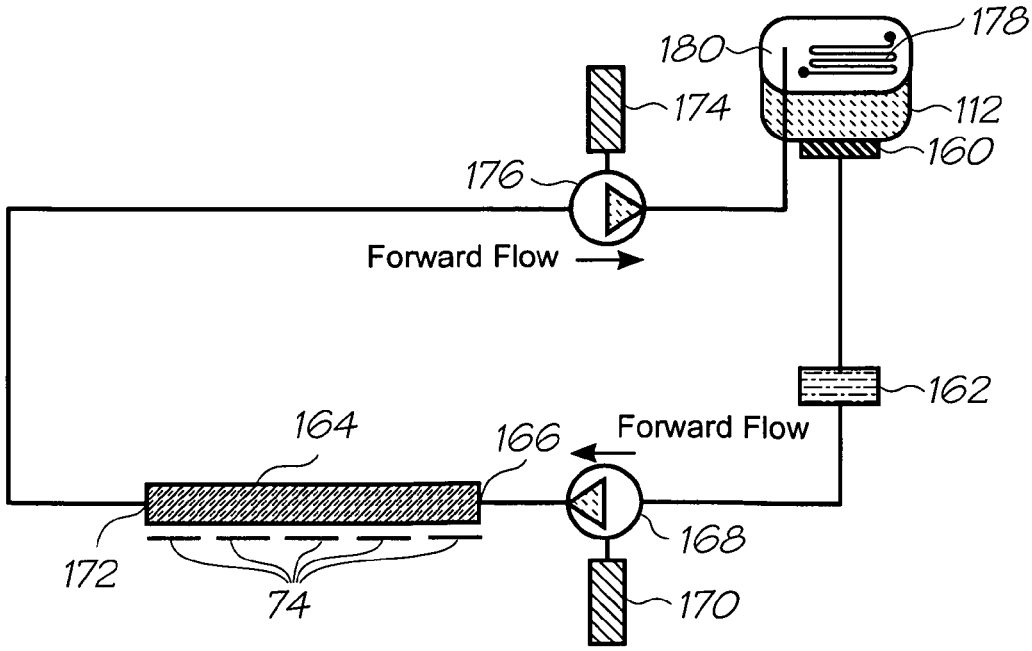
FIG. 13 is a sketch of a dual pump embodiment of the active fluidic system of the present invention; and, FIG. 14 is a sketch of a single pump embodiment of the active fluidic system of the present invention.

FIG. 13 is a fluid architecture in which the printhead IC 74 is not the end of the ink line. The channels 67 in the LCP molding 164 are fed with ink from the ink tank 112 via a filter and pressure regulator 162. The inlet 166 to the LCP ink manifold 164 is at one end instead a point intermediate the ends. As with the prior art fluid system, the ink is still fed to the smaller conduits 70 (see FIG. 10) and finally the printhead IC's 74. However, the invention provides an ink outlet 172 at the opposite end of the LCP manifold 164 so that the ink line continues downstream to connect the LCP manifold back to the ink tank 112. If necessary, the downstream ink line could lead to an ink sump (not shown) but it will be appreciated that this is an inefficient use of ink.

Optionally, the fluidic system can have a branched downstream ink line that can selectively feed to a sump or recirculate back to the ink tank 112. This option is useful if the downstream ink flow is likely to be contaminated with other inks. The downstream flow can be initially diverted to the sump until the LCP manifold has been flushed, and then recirculated to the ink tank 112 once again. The upstream ink line has a pump 168 driven by motor 170. Similarly, the downstream ink line has a pump 176 driven by another motor 174. Optionally, the upstream and downstream pumps are not two separate pumps, but rather two separate lines running through a single pump. This can be implemented with a six-way peristaltic pump head driven with a single motor. However, for the purposes of illustrating the conceptual basis of the system, the pumps 168 and 176 are shown as separate elements with individual drives 170 and 174.

The downstream ink line terminates at an ink outlet 180 in the ink tank 112. Returning the ink to the ink tank 112 is, of course, far more efficient than purging it to a waste sump. Using this system, outgassing bubbles can completely bypass the printhead IC 74 in favour of the downstream ink line. Any bubble introduced into the ink line when the ink cartridges are replaced can also be purged. Likewise, the pressure from the upstream pump 168 can be used to recover dried and or clogged nozzles. In fact, all the printhead maintenance requirements listed above can be performed automatically or user initiated with the active control system shown.

Controlled Printhead Assembly Deprime

The ink tank 112 has an air inlet 178 so that the LCP manifold can be deprimed of ink if desired. Depriming for storage or shipping guards against ink leakage or color mixing between ink lines during period of inactivity (discussed above). It also allows the user to reprime the printhead assembly to a known 'good' state before use or after an inadvertent deprime. Depriming the LCP manifold is also useful for cleaning particulates from the exposed face of the printhead IC's 74 by creating an ink foam. By depriming the LCP manifold 164, residual ink remains in the small conduits 70 and the printhead IC's 74. Pumping air with the upstream pump 168 and shutting off the downstream flow by stopping pump 176, the air escapes through the ejection nozzles and foams the residual ink. This cleaning technique is described in detail in the Applicant's co-pending applications (temporarily referred to here by the Docket Nos FNE27US, FNE28US and FNE29US) the contents of which are incorporated herein by reference.

The upstream and downstream pumps 114 and 116 can be provided by peristaltic pumps. In the printers of the type shown in the above referenced U.S. Ser. No. 11/014,769 (our docket RRC001US) the peristaltic pumps have a displacement resolution of 10 microliters. This equates to about 5 mm of travel on an appropriately dimensional peristaltic tube. These specifications give the most flow rate of about 3 millilitres per minute and very low pulse in the resulting flow.

Figure 14:
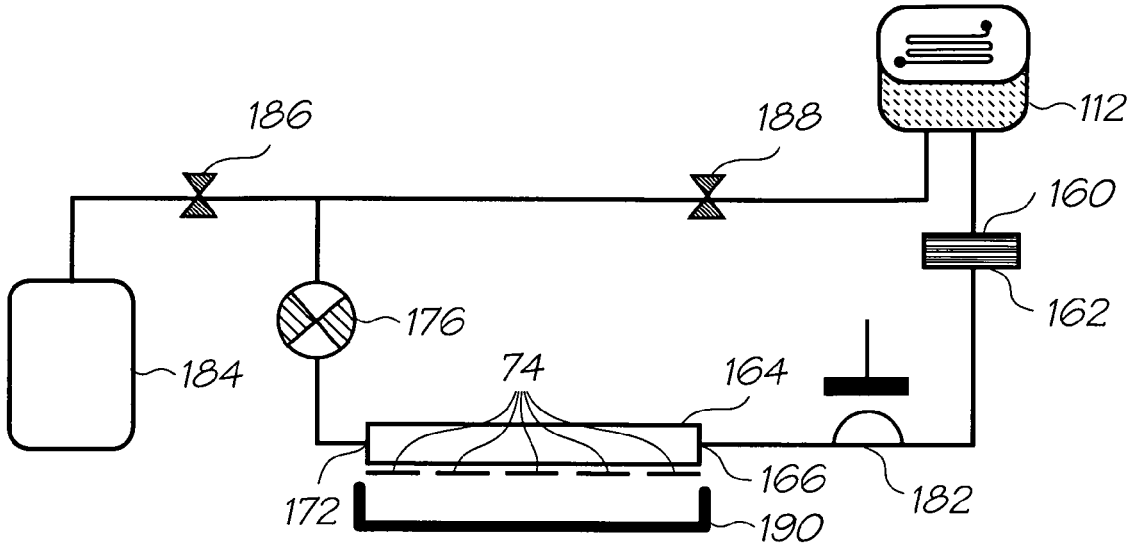

FIG. 14 shows a single pump implementation of the fluidic control system. The upstream pump has been replaced with an impulse generator in the form of an accumulator 182. The accumulator generates a short pressure burst to prime the fine structures (conduits 70) of the LCP manifold and the printhead IC 74. In this embodiment, the downstream pump 176 sucks ink into the LCP manifold 164. To prevent air being drawn in through the nozzles of the printhead IC's, a capping member 190 forms a perimeter seal over the nozzle array. Once the pump 176 has filled the main channels 67 of the LCP manifold, the accumulator 182 creates an impulse to prime the nozzles of the printhead IC 74. The impulse also floods the face of the printhead IC with ink. The flooded-ink may be removed with mechanisms described in the above referenced FNE27US, FNE28US and FNE29US. Once the nozzle flood has been cleaned, a brief purge print will print out any superficial mixed ink.

The single pump embodiment uses three valves per color—a sump valve 186, an ink tank valve 188 and the accumulator 182 (which can be open or closed). Ideally, the valves should be zero displacement, zero leak, fast and easy to actuate. Ordinary workers in this field will readily identify a range of suitable valve mechanisms. Obviously, the accumulator will not be zero displacement but the pressure impulse is often required immediately prior to its role as a shut off valve so its displacement is not generally detrimental. For a three color printer, the fluidic system involves nine valves, three pumps and the perimeter seal on the capper. Hence the control of flow conditions within the printhead assembly is provided using relatively few active components.

The invention has been described herein by way of example only. Skilled workers in this field will readily recognise many variations and modifications which do not depart from the spirit and scope of the broad inventive concept.

We claim:

1. An inkjet printer comprising:

an ink manifold having an ink inlet and an ink outlet;

one or more printhead ICs attached to the ink manifold such that ink is distributed from the ink manifold to said printhead ICs, said printhead ICs arranged to extend across the width of a printhead assembly for pagewidth printing and having an array of ink ejection nozzles;

an upstream ink line connected to the ink inlet;

an accumulator for holding a volume of ink such that the volume of ink is ejected when the accumulator is activated to cause a positive pressure pulse, the accumulator being positioned in the upstream ink line such that the positive pressure pulse primes the printhead ICs with ink from the ink manifold;

a downstream ink line connected to the ink outlet; and, a downstream pump in the downstream ink line for fluid communication with the ink outlet;

a gas inlet that can be:

opened to establish fluid communication between the ink manifold and a supply of gas so as to de-prime the ink manifold by forcing residual ink from the ink manifold through the nozzles; and closed to form a gas tight seal for priming the ink manifold; -wherein, the downstream pump is independently operable.

2. An inkjet printer according to claim 1 wherein the gas inlet is an air inlet which can open to atmosphere.

3. An inkjet printer according to claim 2 wherein the downstream ink line connects the ink manifold to the ink supply via the downstream pump and the outlet of the ink manifold is in fluid communication with a gas vent for gas drawn into the ink manifold during depriming.

4. An inkjet printer according to claim 3 wherein the gas vent is in the ink supply.

5. An inkjet printer according to claim 1 wherein the hydrostatic pressure in the ink at the ink ejection nozzle is less than atmospheric.

6. An inkjet printer according to claim 1 wherein downstream pump is reversible for pumping fluid in a reverse direction.

7. An inkjet printer according to claim 1 the downstream pump is a peristaltic pump.

8. An inkjet printer according to claim 1 wherein the downstream pump is provided by a six-way peristaltic pump head driven by a single motor, the six way pump head having two independently operable three way pump heads.

9. An inkjet printer according to claim 1 wherein the downstream pump is driven by a separate motor.

10. An inkjet printer according to claim 1 wherein the upstream ink line has a pressure regulator that allows ink to flow to the ink manifold at a predetermined threshold pressure difference across the pressure regulator.

11. An inkjet printer according to claim 1 further comprising a capping member for sealing the array of nozzles on the printhead IC.

12. An inkjet printer according to claim 1 wherein the printer is a color printer with a separate ink supplies for each ink color, and respective inlets and outlets for each ink color in the ink manifold.

13. An inkjet printer according to claim 1 wherein the printhead IC is a pagewidth printhead and the ink manifold is an elongate structure with the inlet at one end and the outlet at the opposite end.

14. An inkjet printer according to claim 1 wherein the downstream pump can operate at different flow rates.

15. An inkjet printer according to claim 1 wherein the downstream pump is configured to act as shut off valve in the down stream line.

16. An inkjet printer according to claim 1 wherein the printer further comprises an ink filter upstream of the ink manifold for removing bubbles and contaminants from ink flowing to the manifold.

* * * * *